US012716601B2

(12) United States Patent
Nakao

(10) Patent No.: US 12,716,601 B2
(45) Date of Patent: Aug. 25, 2026

(54) OPERATION CONTROL SYSTEM, OPERATION CONTROL APPARATUS, AND OPERATION CONTROL METHOD

(71) Applicant: DAIKIN INDUSTRIES, LTD., Osaka (JP)

(72) Inventor: Takuya Nakao, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 948 days.

(21) Appl. No.: 17/991,264

(22) Filed: Nov. 21, 2022

(65) Prior Publication Data

US 2023/0083687 A1 Mar. 16, 2023

Related U.S. Application Data

(63) Continuation of application No. PCT/JP2021/020247, filed on May 27, 2021.

(30) Foreign Application Priority Data

May 28, 2020 (JP) ..... 2020-093321

(51) Int. Cl.
*F24F 11/47* (2018.01)
*F24F 11/42* (2018.01)
*F24F 140/60* (2018.01)

(52) U.S. Cl.
CPC ..... *F24F 11/47* (2018.01); *F24F 11/42* (2018.01); *F24F 2140/60* (2018.01)

(58) Field of Classification Search
None
See application file for complete search history.

(56) References Cited

U.S. PATENT DOCUMENTS

2004/0254654 A1* 12/2004 Donnelly ..... H02J 3/14 700/22
2009/0240381 A1 9/2009 Lane
(Continued)

FOREIGN PATENT DOCUMENTS

JP 63-201442 A 8/1988
JP 2001-197661 A 7/2001
(Continued)

OTHER PUBLICATIONS

Machine Translation of JP-6589228-B1 (Year: 2019).*
(Continued)

*Primary Examiner* — Kenneth M Lo
*Assistant Examiner* — Istiaque Ahmed
(74) *Attorney, Agent, or Firm* — Spencer Fane LLP

(57) ABSTRACT

An operation control system includes a storage unit that stores electric-power information, and a determination unit. The determination unit determines, based on the electric-power information, a special-operation timing at which a special operation of a refrigerant cycle apparatus installed in at least one property or at least one area is to be executed. The electric-power information includes at least one of electric-power supply demand adjustment request information related to an electric-power supply demand adjustment request from an outside to the property or the area, and electric-power market price information related to an electric-power market price. The special operation includes at least one of a cooling-time oil return operation during a cooling operation of the refrigerant cycle apparatus, a heating-time oil return operation during a heating operation of the refrigerant cycle apparatus, and a defrosting operation during a heating operation of the refrigerant cycle apparatus.

17 Claims, 6 Drawing Sheets

(56) References Cited

U.S. PATENT DOCUMENTS

| | | | | |
|---|---|---|---|---|
| 2012/0209445 | A1* | 8/2012 | Kim | H04L 12/2827 700/296 |
| 2014/0374497 | A1* | 12/2014 | Nikaido | F25B 1/10 236/1 C |
| 2016/0123644 | A1* | 5/2016 | Yoshimi | H02J 13/14 62/160 |
| 2018/0032045 | A1 | 2/2018 | Murakami et al. | |
| 2019/0346188 | A1* | 11/2019 | Ishiyama | F25B 49/022 |
| 2022/0099347 | A1* | 3/2022 | Mochizuki | F25B 49/022 |
| 2023/0116964 | A1* | 4/2023 | Sun | F24F 11/39 700/276 |

FOREIGN PATENT DOCUMENTS

| | | | |
|---|---|---|---|
| JP | 2006-322629 | A | 11/2006 |
| JP | 3856039 | B2 | 12/2006 |
| JP | 2011-76801 | A | 4/2011 |
| JP | 4937032 | B2 | 5/2012 |
| JP | 5199694 | B2 | 5/2013 |
| JP | 6191897 | B1 | 9/2017 |
| JP | 2018-157615 | A | 10/2018 |
| JP | 6589228 | B1 * | 10/2019 |
| JP | 2020-65346 | A | 4/2020 |

OTHER PUBLICATIONS

International Search Report of corresponding PCT Application No. PCT/JP2021/020247 dated Aug. 24, 2021.

International Preliminary Report of corresponding PCT Application No. PCT/JP2021/020247 dated Dec. 8, 2022.

Matsukawa et al.; Prediction Model on Disturbance of Maintenance Operation During Real-Time Pricing Adaptive Control for Building Air-Conditioners; IEEJ Transactions on Electrical IEEJ Trans 2019 and Electronic Engineering; 2019 pp. 1219-1225.

1 European Search Report of corresponding EP Application No. 21 81 3670.3 dated Oct. 31, 2023.

* cited by examiner

OPERATION CONTROL SYSTEM, OPERATION CONTROL APPARATUS, AND OPERATION CONTROL METHOD

CROSS-REFERENCE TO RELATED APPLICATIONS

This is a continuation of International Application No. PCT/JP2021/020247 filed on May 27, 2021, which claims priority to Japanese Patent Application No. 2020-093321, filed on May 28, 2020. The entire disclosures of these applications are incorporated by reference herein.

BACKGROUND

Technical Field

The present disclosure relates to an operation control system, an operation control apparatus, and an operation control method for performing demand response control.

Background Art

As described in Japanese Unexamined Patent Application Publication No. 2001-197661, a system has been conventionally used that performs demand response control for adjusting the amount of electric power used by a refrigerant cycle apparatus, such as an air conditioner, installed in a property, so that the electric power demanded by the refrigerant cycle apparatus does not exceed a predetermined supplied electric power.

SUMMARY

An operation control system according to a first aspect includes a storage unit and a determination unit. The storage unit stores electric-power information. The determination unit is configured to determine, based on the electric-power information, a special-operation timing at which a special operation of a refrigerant cycle apparatus installed in at least one property or at least one area is to be executed. The electric-power information includes at least one of electric-power supply demand adjustment request information related to an electric-power supply demand adjustment request from an outside to the property or the area, and electric-power market price information related to an electric-power market price. The special operation includes at least one of a cooling-time oil return operation during a cooling operation of the refrigerant cycle apparatus, a heating-time oil return operation during a heating operation of the refrigerant cycle apparatus, and a defrosting operation during a heating operation of the refrigerant cycle apparatus.

DETAILED DESCRIPTION OF EMBODIMENT(S)

First Embodiment

(1) Overall Configuration of Operation Control System 100

Figure 1:
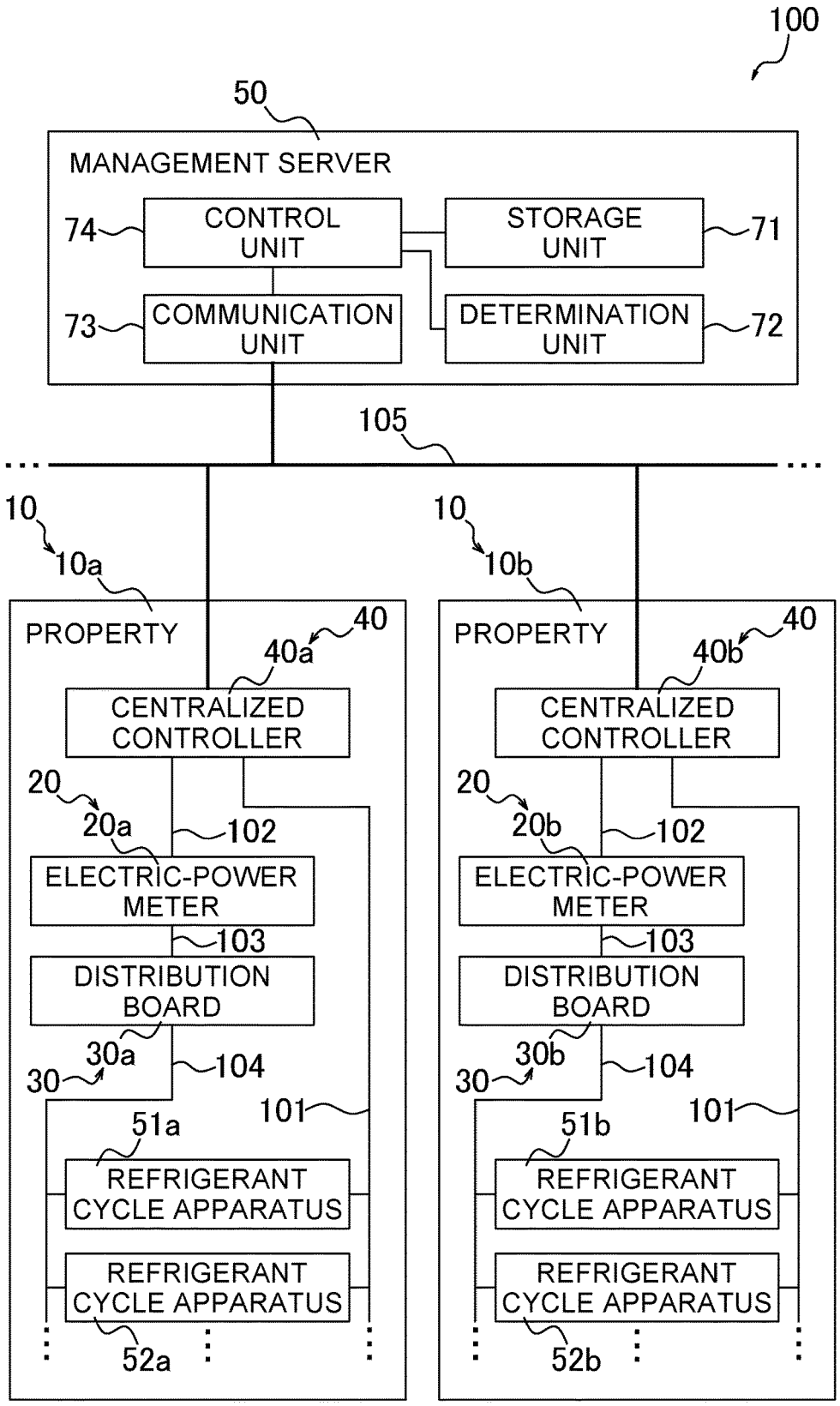
FIG. 1 is a configuration diagram of an operation control system 100 according to a first embodiment.

As shown in FIG. 1, an operation control system 100 according to a first embodiment is a system that controls the operations of refrigerant cycle apparatuses 51*a*, . . . (51*a*, 52*a*, . . . , 51*b*, 52*b*, . . . ) installed in at least one property 10 (10*a*, 10*b*, . . . ). The refrigerant cycle apparatuses 51*a*, . . . are apparatuses having at least one of a freezing function and a refrigeration function. In the present embodiment, the refrigerant cycle apparatuses 51*a*, . . . are air conditioning apparatuses that perform at least one of a cooling operation and a heating operation for conditioning the air in predetermined air-conditioning target spaces in the properties 10. The refrigerant cycle apparatuses 51*a*, . . . may be other equipment except an air conditioning apparatus, or may be combinations of an air conditioning apparatus and other equipment. The other equipment is, for example, a freezing apparatus and a refrigeration apparatus for adjusting the temperature inside a showcase installed in the property 10.

The operation control system 100 is used as a system for performing demand response control. The demand response control is control for adjusting the amount of electric power used by the refrigerant cycle apparatuses 51*a*, . . . so that the electric power demanded by the refrigerant cycle apparatuses 51*a*, . . . does not exceed a predetermined supplied electric power. The operation control system 100 adjusts the amount of electric power used by the refrigerant cycle apparatuses 51*a*, . . . on the basis of a request from the outside related to an electric-power supply demand adjustment with a trend toward suppressing or promoting the electric-power consumption of the refrigerant cycle apparatuses 51*a*, . . . . The request from the outside related to an electric-power supply demand adjustment is, for example, an input related to an electric-power supply demand adjustment input by an administrator or the like of the operation control system 100.

The operation control system 100 mainly includes the refrigerant cycle apparatuses 51*a*, . . . , electric-power meters 20 (20*a*, 20*b*, . . . ), distribution boards 30 (30*a*, 30*b*, . . . ), centralized controllers 40 (40*a*, 40*b*, . . . ), and a management server 50. The refrigerant cycle apparatuses 51*a*, . . . , the electric-power meter 20, the distribution board 30, and the centralized controller 40 are installed in each property 10. In each property 10, the refrigerant cycle apparatuses 51*a*, . . . are coupled to the centralized controller 40 via a first line 101. In each property 10, the electric-power meter 20 is coupled to the centralized controller 40 via a second line 102. In each property 10, the distribution board 30 is coupled to the electric-power meter 20 via a third line 103, and is coupled to the refrigerant cycle apparatuses 51*a*, . . . via a fourth line 104.

The electric-power meter 20 of each property 10 measures the electric power consumed by each of the refrigerant cycle apparatuses 51*a*, . . . installed in the property 10.

The distribution board 30 of each property 10 supplies a predetermined amount of electric power from an external power source to each of the refrigerant cycle apparatuses 51*a*, . . . installed in the property 10.

The centralized controller 40 of each property 10 controls each of the refrigerant cycle apparatuses 51*a*, . . . installed in the property 10. For example, the centralized controller 40 receives, from the electric-power meter 20, information related to the electric power consumed by each of the refrigerant cycle apparatuses 51*a*, . . . , and transmits, to the distribution board 30, information related to the electric power to be supplied to each of the refrigerant cycle apparatuses 51*a*, . . . .

The management server 50 is installed outside the properties 10, and is coupled to the centralized controller 40 of each property 10 via a public line 105, such as the Internet. The management server 50 controls the refrigerant cycle apparatuses 51*a*, . . . via the centralized controllers 40.

(2) Configurations and Action of Refrigerant Cycle Apparatuses 51*a*, . . . .

Figure 2:
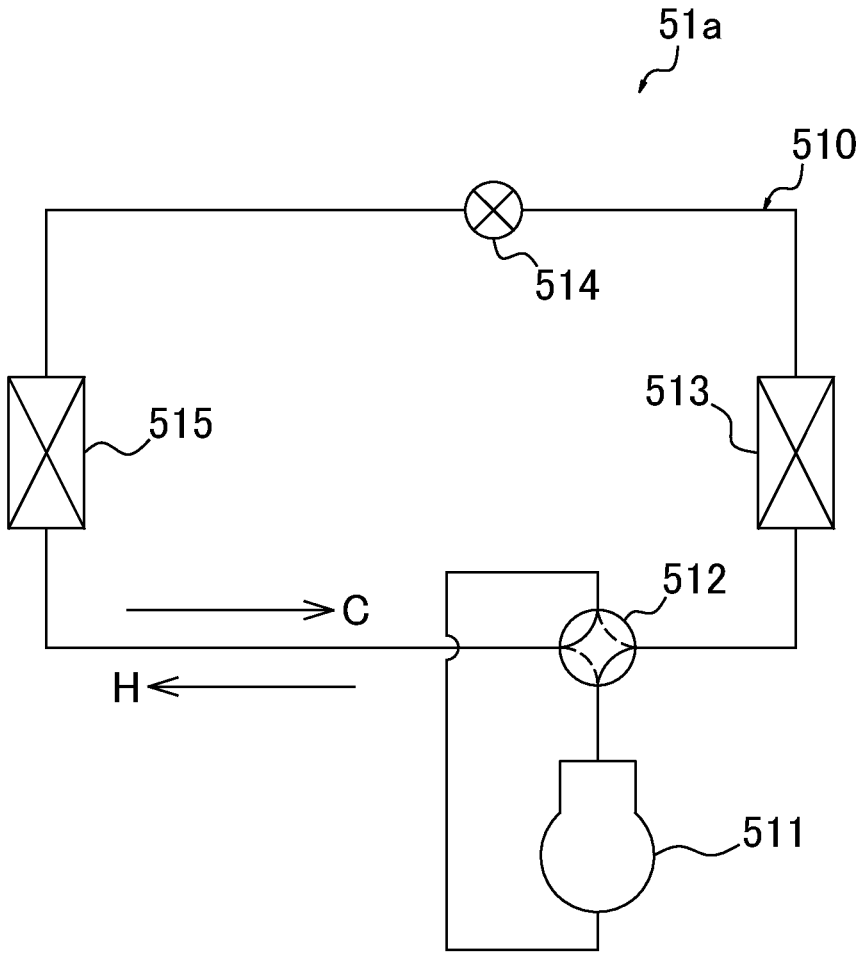
FIG. 2 is a configuration diagram of refrigerant cycle apparatuses 51*a*, . . . .

As shown in FIG. 2, the refrigerant cycle apparatuses 51*a*, . . . mainly include a compressor 511, a four-way switching valve 512, a heat-source-side heat exchanger 513, an expansion mechanism 514, and a usage-side heat exchanger 515. These are coupled to each other via a refrigerant pipe to form a refrigerant circuit 510 through which a refrigerant circulates.

The compressor 511 sucks and compresses low-pressure gas refrigerant flowing through the refrigerant circuit 510 to discharge high-pressure gas refrigerant.

The four-way switching valve 512 switches coupling states of the refrigerant pipe of the refrigerant circuit 510. In a case where the refrigerant cycle apparatuses 51*a*, . . . perform a cooling operation, the four-way switching valve 512 forms a coupling state indicated by solid lines in FIG. 2. In a case where the refrigerant cycle apparatuses 51*a*, . . . perform a heating operation, the four-way switching valve 512 forms a coupling state indicated by broken lines in FIG. 2.

The heat-source-side heat exchanger 513 performs heat exchange between air and the refrigerant circulating through the refrigerant circuit 510. In a case where the refrigerant cycle apparatuses 51*a*, . . . perform a cooling operation, the heat-source-side heat exchanger 513 functions as a radiator (condenser). In a case where the refrigerant cycle apparatuses 51*a*, . . . perform a heating operation, the heat-source-side heat exchanger 513 functions as a heat absorber (evaporator).

The expansion mechanism 514 is an electronic expansion valve whose opening degree can be adjusted. The expansion mechanism 514 decompresses the refrigerant flowing through the refrigerant pipe of the refrigerant circuit 510. The expansion mechanism 514 controls the flow rate of the refrigerant flowing through the refrigerant pipe of the refrigerant circuit 510.

The usage-side heat exchanger 515 performs heat exchange between air and the refrigerant circulating through the refrigerant circuit 510. In a case where the refrigerant cycle apparatuses 51*a*, . . . perform a cooling operation, the usage-side heat exchanger 515 functions as a heat absorber (evaporator). In a case where the refrigerant cycle apparatuses 51*a*, . . . perform a heating operation, the usage-side heat exchanger 515 functions as a radiator (condenser).

In a case where the refrigerant cycle apparatuses 51*a*, . . . are an air conditioning apparatus, the compressors 511, the four-way switching valve 512, the heat-source-side heat exchanger 513, and the expansion mechanism 514 are installed outdoors, such as on the roof of the property 10, and the usage-side heat exchanger 515 is installed in the air-conditioning target space of the property 10.

In a case where the refrigerant cycle apparatuses 51*a*, . . . are an air conditioning apparatus, the refrigerant cycle apparatuses 51*a*, . . . may include a plurality of usage-side heat exchangers 515 coupled to one heat-source-side heat exchanger 513.

The refrigerant used in the refrigerant cycle apparatuses 51*a*, . . . generates a change accompanied by phase transition, such as condensation or evaporation, in the heat-source-side heat exchanger 513 and the usage-side heat exchanger 515. However, the refrigerant does not necessarily generate a change accompanied by phase transition in the heat-source-side heat exchanger 513 and the usage-side heat exchanger 515.

(2-1) Cooling Operation

In a case where the refrigerant cycle apparatuses 51*a*, . . . perform cooling operations, the refrigerant circulates in the direction of an arrow C in FIG. 2. In this case, the heat-source-side heat exchanger 513 and the usage-side heat exchanger 515 function as a radiator and a heat absorber, respectively.

During a cooling operation, high-pressure gas refrigerant discharged from the compressor 511 reaches the heat-source-side heat exchanger 513 via the four-way switching valve 512. In the heat-source-side heat exchanger 513, the high-pressure gas refrigerant is made to exchange heat with air (outside air) to be condensed, and changes to high-pressure liquid refrigerant. Then the high-pressure liquid refrigerant is decompressed when passing through the expansion mechanism 514, and changes to low-pressure gas-liquid-two-phase refrigerant. Then in the usage-side heat exchanger 515, the low-pressure gas-liquid-two-phase refrigerant is made to exchange heat with the air in the air-conditioning target space of the property 10 to be evaporated, and changes to low-pressure gas refrigerant. Thus, the temperature of the air in the air-conditioning target space of the property 10 decreases. Then the low-pressure gas refrigerant reaches the compressor 511 via the four-way switching valve 512. Then the compressor 511 sucks the low-pressure gas refrigerant.

(2-2) Heating Operation

In a case where the refrigerant cycle apparatuses 51*a*, . . . perform heating operations, the refrigerant circulates in the direction of an arrow H in FIG. 2. In this case, the heat-source-side heat exchanger 513 and the usage-side heat exchanger 515 function as a heat absorber and a radiator, respectively.

During a heating operation, high-pressure gas refrigerant discharged from the compressor 511 reaches the usage-side heat exchanger 515 via the four-way switching valve 512. In the usage-side heat exchanger 515, the high-pressure gas refrigerant is made to exchange heat with air in the air-conditioning target space of the property 10 to be condensed, and changes to high-pressure liquid refrigerant. Thus, the temperature of the air in the air-conditioning target space of the property 10 increases. Then the high-pressure liquid refrigerant is decompressed when passing through the expansion mechanism 514, and changes to low-pressure gas-liquid-two-phase refrigerant. Then in the heat-source-side heat exchanger 513, the low-pressure gas-liquid-two-phase refrigerant is made to exchange heat with air (outside air) to be evaporated, and changes to low-pressure gas refrigerant. Then the low-pressure gas refrigerant reaches the compressor 511 via the four-way switching valve 512. Then the compressor 511 sucks the low-pressure gas refrigerant.

(3) Action of Operation Control System 100

The operation control system 100 performs control related to the execution of normal operations and special operations of the refrigerant cycle apparatuses 51*a*, . . . on the basis of a request from the outside related to an electric-power supply demand adjustment. The normal operations are cooling operations and heating operations of the refrigerant cycle apparatuses 51*a*, . . . , and are operations for adjusting at least one of the temperature or the moisture of the air-conditioning target space of each property 10. The special operations are operations executed at predetermined timings to suppress a decrease in the capacities of the normal operations of the refrigerant cycle apparatuses 51*a*, . . . . The special operation is at least one of a cooling-time oil return operation, a heating-time oil return operation, and a defrosting operation. The cooling-time oil return operation is an oil return operation during cooling operations of the refrigerant cycle apparatuses 51*a*, . . . . The heating-time oil return operation is an oil return operation during heating operations of the refrigerant cycle apparatuses 51*a*, . . . . The defrosting operation is an operation performed during the heating operations of the refrigerant cycle apparatuses 51*a*, . . . .

The oil return operation (the cooling-time oil return operation and the heating-time oil return operation) is an operation for forcibly returning, to the compressor 511, refrigerating-machine oil that has flowed out from the compressor 511 during normal operations of the refrigerant cycle apparatuses 51*a*, . . . and has stayed in the refrigerant circuit 510 except the compressor 511. When the refrigerating-machine oil stored in the compressor 511 is insufficient, the sliding portions of the compressor 511 may be insufficiently lubricated, and the compression efficiency may decrease. As a result, the operation capacities of the refrigerant cycle apparatuses 51*a*, . . . may decrease. To this end, the oil return operation is performed to suppress the decrease in the operation capacities of the refrigerant cycle apparatuses 51*a*, . . . .

The defrosting operation is an operation for removing frost that generated on the heat-source-side heat exchanger 513 during heating operations of the refrigerant cycle apparatuses 51*a*, . . . . In a case where the humidity of the outside air is high, frost tends to adhere to the heat exchange portion of the heat-source-side heat exchanger 513. When the surface of the heat exchange portion of the heat-source-side heat exchanger 513 is covered with frost, the heat exchange capacity of the heat-source-side heat exchanger 513 may decrease, and the operation capacities of the refrigerant cycle apparatuses 51*a*, . . . may decrease. To this end, the defrosting operation is performed to suppress the decrease in the operation capacities of the refrigerant cycle apparatuses 51*a*, . . . .

The management server 50 controls the refrigerant cycle apparatuses 51*a*, . . . so that the special operations of the refrigerant cycle apparatuses 51*a*, . . . are executed at a predetermined timing. Next, a start condition, action, an end condition, and a consumed-electric-power trend of each special operation will be described.

(3-1) Cooling-Time Oil Return Operation (3-1-1) Start Condition

The management server 50 starts a cooling-time oil return operation in a case where any one of the following condition A1 and condition B1 is satisfied.

Condition A1: The integrated values of times during which normal operations of the refrigerant cycle apparatuses 51*a*, . . . have been executed after the end time points of the previous special operations become equal to or more than a predetermined threshold.

Condition B1: The oil rise amounts of the compressors 511 after the end time points of the previous special operations become equal to or more than a predetermined threshold.

The oil rise amounts are amounts of refrigerating-machine oil that has flowed out from the compressors 511 during normal operations of the refrigerant cycle apparatuses 51*a*, . . . . The oil rise amount is calculated on the basis of, for example, the number of revolutions of the compressor 511 during a normal operation and an integrated value of a time during which a normal operation has been executed.

The "end time point of the previous special operation" is a time point at which any one of the end of a cooling-time oil return operation, the end of a heating-time oil return operation, and the end of a defrosting operation is fulfilled.

(3-1-2) Action

The management server 50 executes a cooling-time oil return operation by temporarily increasing the number of revolutions of the compressor 511 and the opening degree of the expansion mechanism 514 while the cooling operation is continued. Thus, the amount of refrigerant flowing through the usage-side heat exchanger 515 temporarily increases, and refrigerating-machine oil staying in the usage-side heat exchanger 515 moves to the compressor 511. The management server 50 may execute a plurality of cooling-time oil return operations at predetermined time intervals.

(3-1-3) End Condition

The management server 50 ends a cooling-time oil return operation in a case where any one of the following condition C1 and condition D1 is satisfied.

Condition C1: The time during which an oil return operation has been continuously executed becomes equal to or more than a predetermined threshold.

Condition D1: A predetermined amount of refrigerating-machine oil has been returned to the compressor 511.

The amount of refrigerating-machine oil that has been returned to the compressor 511 is calculated on the basis of, for example, a detection value of the degree of superheating of low-pressure gas refrigerant sucked into the compressor 511. Since during a cooling-time oil return operation, the amount of refrigerant flowing through the usage-side heat exchanger 515 temporarily increases, the degree of wetness of the refrigerant flowing through the usage-side heat exchanger 515 becomes larger, and the degree of superheating of the refrigerant flowing through the usage-side heat exchanger 515 becomes smaller.

(3-1-4) Consumed-Electric-Power Trend

Figure 3:
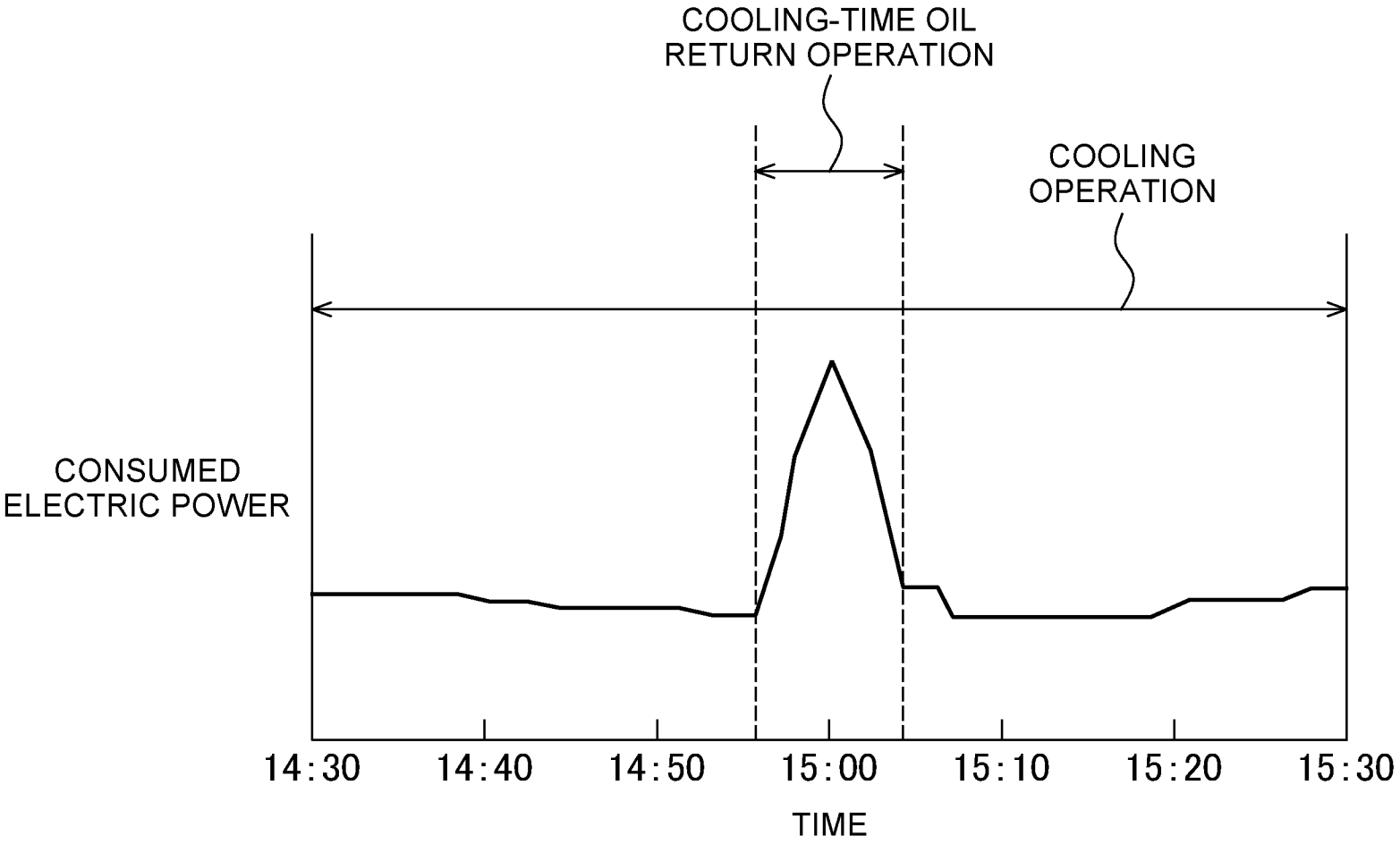
FIG. 3 is a graph showing an example of a consumed-electric-power trend of a cooling-time oil return operation.

Since during a cooling-time oil return operation, the number of revolutions of the compressor 511 temporarily increases, as shown in FIG. 3, the electric power consumed by the refrigerant cycle apparatuses 51*a*, . . . temporarily increases. Since a cooling operation is continuously executed during a cooling-time oil return operation, the difference between the consumed electric power before the cooling-time oil return operation and the consumed electric power after the cooling-time oil return operation is small.

(3-2) Heating-Time Oil Return Operation (3-2-1) Start Condition

The management server 50 starts a heating-time oil return operation in a case where any one of the following condition A2 and condition B2 is satisfied.

Condition A2: The integrated values of times during which normal operations of the refrigerant cycle apparatuses 51*a*, . . . have been executed after the end time points of the previous special operations become equal to or more than a predetermined threshold.

Condition B2: The oil rise amounts of the compressors 511 after the end time points of the previous special operations become equal to or more than a predetermined threshold.

(3-2-2) Action

The management server 50 executes a heating-time oil return operation by controlling the four-way switching valve 512 to switch the refrigerant circuit 510 to a circuit at a time of a cooling operation, and temporarily increasing the opening degree of the expansion mechanism 514. Thus, refrigerating-machine oil staying in the usage-side heat exchanger 515 moves to the compressor 511. The management server 50 may execute a plurality of heating-time oil return operations at predetermined time intervals.

(3-2-3) End Condition

The management server 50 ends a heating-time oil return operation in a case where an oil return end condition and a defrosting end condition to be described later are both fulfilled. The oil return end condition is fulfilled in a case where any one of the following condition C2 and condition D2 is satisfied.

Condition C2: The time during which an oil return operation has been continuously executed becomes equal to or more than a predetermined threshold.

Condition D2: A predetermined amount of refrigerating-machine oil has been returned to the compressor 511.

The amount of refrigerating-machine oil that has been returned to the compressor 511 is calculated on the basis of, for example, the amount of refrigerant circulating through the refrigerant circuit 510.

(3-2-4) Consumed-Electric-Power Trend

Figure 4:
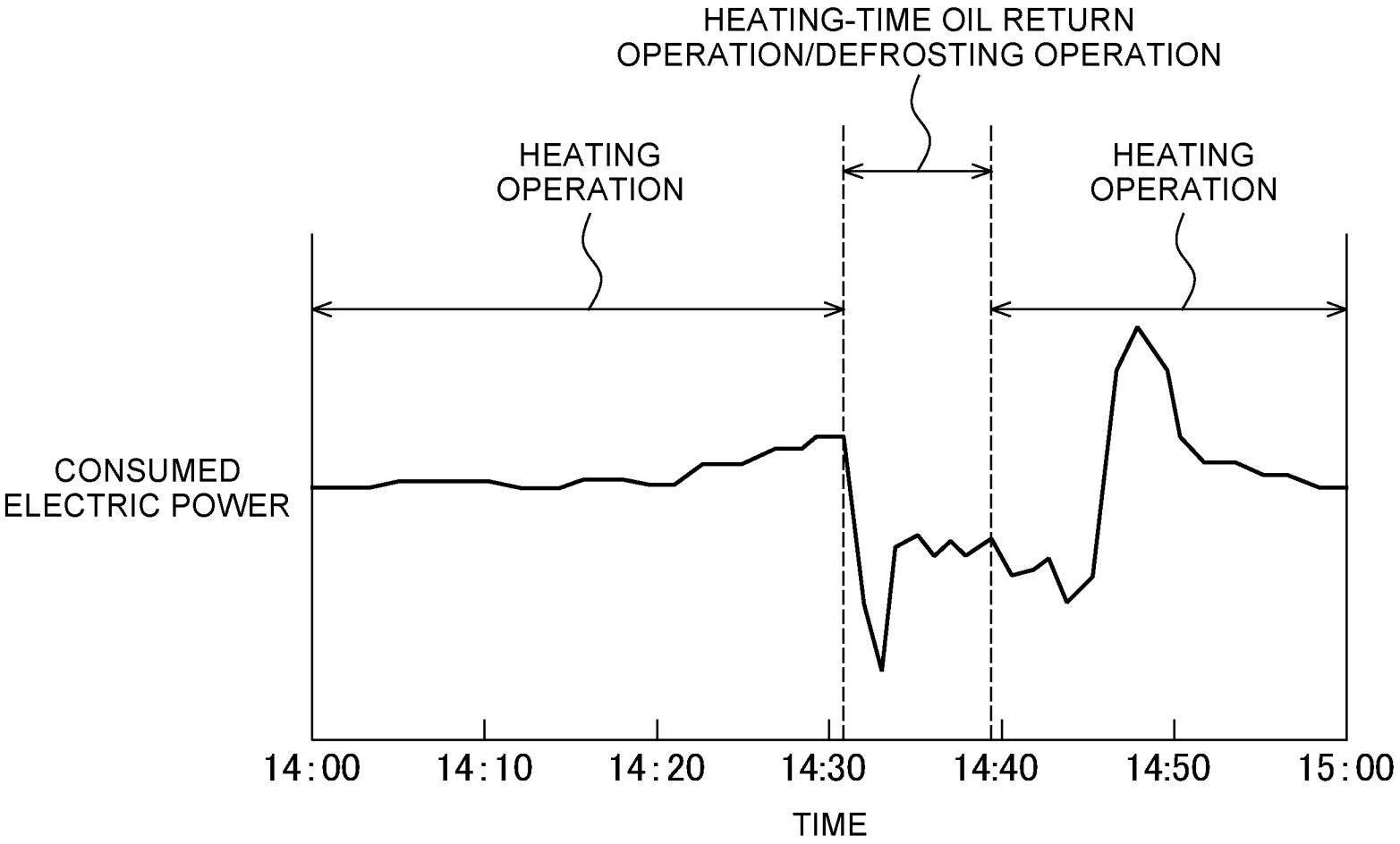
FIG. 4 is a graph showing an example of a consumed-electric-power trend of a heating-time oil return operation and a defrosting operation.

During a heating-time oil return operation, heating operations of the refrigerant cycle apparatuses 51*a*, . . . are temporarily stopped. Further, the number of revolutions of the compressor 511 during a heating-time oil return operation can be made lower than the number of revolutions of the compressor 511 during a heating operation. Therefore, the number of revolutions of the compressor 511 temporarily diminishes during a heating-time oil return operation. Therefore, as shown in FIG. 4, during a heating-time oil return operation, the electric power consumed by the refrigerant cycle apparatuses 51*a*, . . . temporarily diminishes.

Since during a heating-time oil return operation, heating operations of the refrigerant cycle apparatuses 51*a*, . . . are temporarily stopped, the temperature of air in the air-conditioning target space of the property 10 decreases. Therefore, in a case where as shown in FIG. 4, a heating operation is restarted after the end of a heating-time oil return operation, the electric power consumed by the refrigerant cycle apparatuses 51*a*, . . . temporarily increases.

(3-3) Defrosting Operation (3-3-1) Start Condition

The management server 50 starts a defrosting operation in a case where any one of the following condition A3, condition B3, and condition C3 is satisfied.

Condition A3: The integrated values of times during which normal operations of the refrigerant cycle apparatuses 51*a*, . . . have been executed after the end time points of the previous special operations become equal to or more than a predetermined threshold.

Condition B3: The heat exchange capacities of the heat-source-side heat exchangers 513 have decreased by a predetermined threshold or more.

Condition C3: Elapsed times from the end time points of the previous heating-time oil return operations become equal to or more than a predetermined threshold.

(3-3-2) Action

The action of a defrosting operation is the same as the action of a heating-time oil return operation.

(3-3-3) End Condition

The management server 50 ends a defrosting operation in a case where the oil return end condition described above and a defrosting end condition are both fulfilled. The defrosting end condition is fulfilled in a case where any one of the following condition D3 and condition E3 is satisfied.

Condition D3: The time during which a defrosting operation has been continuously executed becomes equal to or more than a predetermined threshold.

Condition E3: It has been confirmed that no frost has adhered to the heat exchange portion of the heat-source-side heat exchanger 513.

Whether or not frost has adhered to the heat-source-side heat exchanger 513 may be ascertained on the basis of, for example, a detection value of the temperature of the heat exchange portion of the heat-source-side heat exchanger 513. The heat exchange portion is, for example, a fin.

(3-3-4) Consumed-Electric-Power Trend

As shown in FIG. 4, the consumed-electric-power trend of a defrosting operation is the same as the consumed-electric-power trend of a heating-time oil return operation.

(4) Action of Management Server 50

As shown in FIG. 1, the management server 50 mainly includes a storage unit 71, a determination unit 72, a communication unit 73, and a control unit 74.

The storage unit 71 stores electric-power supply demand adjustment request information related to electric-power supply demand adjustment requests to the properties 10. The electric-power supply demand adjustment requests are requests from the outside related to electric-power supply demand adjustments with a trend toward suppressing or promoting electric-power consumption of the refrigerant cycle apparatuses 51*a*, . . . installed in the properties 10.

On the basis of the electric-power supply demand adjustment request information stored in the storage unit 71, the determination unit 72 determines special-operation timings at which special operations of the refrigerant cycle apparatuses 51*a*, . . . installed in the properties 10 are to be executed.

The communication unit 73 communicates with the centralized controller 40 of each property 10 via the public line 105, such as the Internet.

On the basis of the special-operation timings determined by the determination unit 72, the control unit 74 transmits a control signal for executing a special operation of each of the refrigerant cycle apparatuses 51*a*, . . . , to the centralized controller 40 of each property 10 via the communication unit 73. The control unit 74 acquires information related to the operation of each of the refrigerant cycle apparatuses 51*a*, . . . from the centralized controller 40 of each property 10 via the communication unit 73.

In the present embodiment, the electric-power supply demand adjustment request information includes a negawatt request time period that includes at least one time period that is a target of an electric-power supply demand adjustment request with a trend toward suppressing the electric-power consumption of the refrigerant cycle apparatuses 51*a*, . . . . In this case, the determination unit 72 determines a timing that satisfies at least one of the following first condition and second condition, as the special-operation timing.

First condition: A cooling-time oil return operation is avoided in a negawatt request time period. In other words, no cooling-time oil return operation is executed in a negawatt request time period.

Second condition: At least one of a heating-time oil return operation and a defrosting operation is executed in a negawatt request time period.

In a negawatt request time period, there is a possibility that predicted values of the electric power to be consumed by the refrigerant cycle apparatuses 51*a*, . . . are equal to or more than aim values of the electric power to be consumed by the refrigerant cycle apparatuses 51*a*, . . . . In other words, the negawatt request time period is a time period in which a request is made to cut down the electric-power consumption since there is a possibility that the electric-power supply becomes insufficient. Therefore, in a case where special operations are executed in a negawatt request time period, it is preferable that the electric power consumed by the refrigerant cycle apparatuses 51*a*, . . . is not increased by executing the special operations.

As shown in FIG. 3, while a cooling-time oil return operation is executed, the electric power consumed by the refrigerant cycle apparatuses 51*a*, . . . temporarily increases. Therefore, it is preferable not to execute a cooling-time oil return operation in a negawatt request time period (first condition).

As shown in FIG. 4, while a heating-time oil return operation or a defrosting operation is executed, the electric power consumed by the refrigerant cycle apparatuses 51*a*, . . . temporarily diminishes. Therefore, it is preferable to execute at least one of a heating-time oil return operation and a defrosting operation in a negawatt request time period (second condition).

In the present embodiment, the determination unit 72 determines a special-operation timing in such a manner that at least one of the first condition and the second condition described above is satisfied, and thus can suppress an increase in the consumed electric power in a negawatt request time period.

(5) Features

On the basis of an electric-power supply demand adjustment request from the outside, the operation control system 100 determines timings at which special operations of the refrigerant cycle apparatuses 51*a*, . . . are to be executed, to suppress a decrease in the efficiency of demand response control.

On the basis of a negawatt request time period that is a target of an electric-power supply demand adjustment request with a trend toward suppressing the electric-power consumption of the refrigerant cycle apparatuses 51*a*, . . . , the operation control system 100 according to the present embodiment determines timings at which special operations are to be executed, to suppress a decrease in the efficiency of demand response control.

Second Embodiment

The basic configuration and action of an operation control system 100 according to the present embodiment are the same as the basic configuration and action of the first embodiment. Hereinafter, differences from the first embodiment will be mainly described.

In the present embodiment, electric-power supply demand adjustment request information includes a posiwatt request time period that includes at least one time period that is a target of an electric-power supply demand adjustment request with a trend toward promoting the electric-power consumption of refrigerant cycle apparatuses 51*a*, . . . . In this case, a determination unit 72 determines a timing that satisfies at least one of the following third to fifth conditions, as a special-operation timing.

Third condition: A cooling-time oil return operation is executed in a posiwatt request time period.

Fourth condition: At least one of a heating-time oil return operation and a defrosting operation is avoided in a posiwatt request time period. In other words, at least one of a heating-time oil return operation and a defrosting operation is not executed in a posiwatt request time period.

Fifth condition: At least one of a heating-time oil return operation and a defrosting operation is executed in a time period immediately before a posiwatt request time period.

In a posiwatt request time period, there is a possibility that predicted values of the electric power to be consumed by the refrigerant cycle apparatuses 51*a*, . . . are less than aim values of the electric power to be consumed by the refrigerant cycle apparatuses 51*a*, . . . . In other words, the posiwatt request time period is a time period in which a request is made to promote the electric-power consumption since there is a possibility that the electric-power supply becomes excessive. Therefore, in a case where a special operation is executed in a posiwatt request time period, it is preferable that the electric power consumed by the refrigerant cycle apparatuses 51*a*, . . . is increased by executing the special operation.

As shown in FIG. 3, while a cooling-time oil return operation is executed, the electric power consumed by the refrigerant cycle apparatuses 51*a*, . . . temporarily increases. Therefore, it is preferable to execute a cooling-time oil return operation in a posiwatt request time period (third condition).

As shown in FIG. 4, while a heating-time oil return operation or a defrosting operation is executed, the electric power consumed by the refrigerant cycle apparatuses

51*a*, . . . temporarily diminishes. Therefore, it is preferable not to execute at least one of a heating-time oil return operation and a defrosting operation in a posiwatt request time period (fourth condition).

In a case where as shown in FIG. 4, a heating operation is restarted after the end of a heating-time oil return operation, the electric power consumed by the refrigerant cycle apparatuses 51*a*, . . . temporarily increases. Therefore, it is preferable to execute at least one of a heating-time oil return operation and a defrosting operation in a time period immediately before a posiwatt request time period (fifth condition).

In the present embodiment, the determination unit 72 determines a special-operation timing in such a manner that at least one of the third to fifth conditions described above is satisfied, and thus can promote an increase in the consumed electric power in a posiwatt request time period.

On the basis of a posiwatt request time period that is a target of an electric-power supply demand adjustment request with a trend toward promoting the electric-power consumption of the refrigerant cycle apparatuses 51*a*, . . . , the operation control system 100 according to the present embodiment determines timings at which special operations are to be executed, to suppress a decrease in the efficiency of demand response control.

Modifications

(1) Modification A

Figure 5:
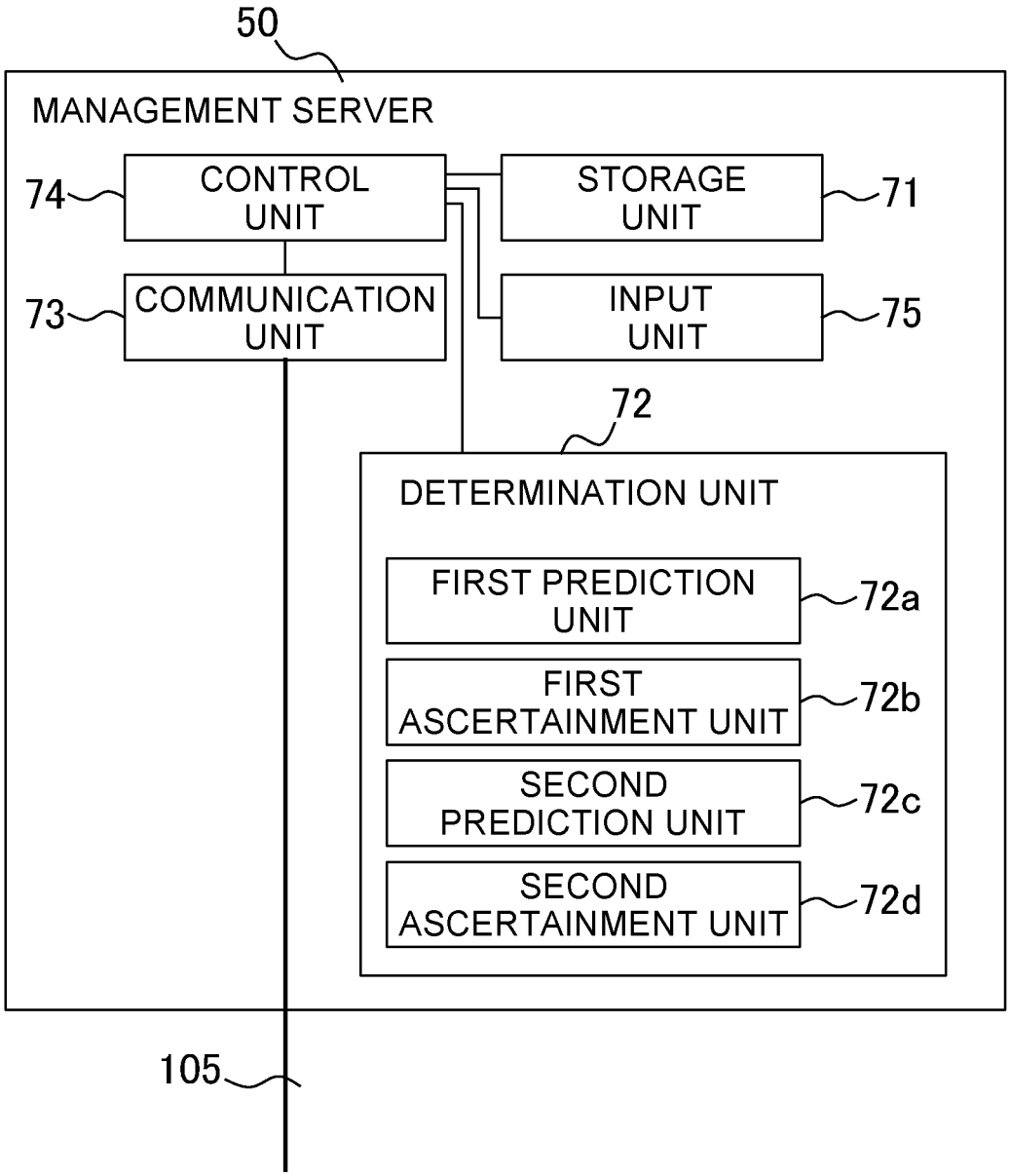
FIG. 5 is a configuration diagram of a management server 50 according to Modifications A to C.

In the present modification, as shown in FIG. 5, the determination unit 72 includes a first prediction unit 72*a* and a first ascertainment unit 72*b*.

On the basis of operation data on the refrigerant cycle apparatuses 51*a*, . . . , the first prediction unit 72*a* predicts timings at which special operations are to be executed. The operation data is data related to normal operations and special operations executed by the refrigerant cycle apparatuses 51*a*, . . . in the past.

The operation data is, for example, parameters used in the above-described start condition of the special operations. Specifically, in a case where special operations that are prediction targets of the first prediction unit 72*a* are a cooling-time oil return operation or a heating-time oil return operation, the operation data includes (a) the integrated values of times during which normal operations of the refrigerant cycle apparatuses 51*a*, . . . have been executed after the end time points of the previous special operations, and (b) the oil rise amounts of the compressors 511 after the end time points of the previous special operations. In a case where special operations that are prediction targets of the first prediction unit 72*a* are a defrosting operation, the operation data includes (c) the integrated values of times during which normal operations of the refrigerant cycle apparatuses 51*a*, . . . have been executed after the end time points of the previous special operations, (d) the heat exchange capacities of the heat-source-side heat exchangers 513, and (e) elapsed times from the end time points of the previous heating-time oil return operations.

The first ascertainment unit 72*b* ascertains whether or not special operations can be executed in a request target time period that includes at least one time period that is a target of an electric-power supply demand adjustment request from the outside. The request target time period is a negawatt request time period and a posiwatt request time period.

The first ascertainment unit 72*b* ascertains whether or not timings (predicted timings) predicted by the first prediction unit 72*a* at which special operations are to be executed can be shifted to the request target time period (can be executed). In a case where the request target time period is a negawatt request time period, the first ascertainment unit 72*b* ascertains whether or not predicted timings of at least one of a heating-time oil return operation and a defrosting operation can be shifted to the request target time period. In a case where the request target time period is a posiwatt request time period, the first ascertainment unit 72*b* ascertains whether or not predicted timings of cooling-time oil return operations can be shifted to the request target time period.

Further, the first ascertainment unit 72*b* ascertains whether or not the predicted timings of the special operations can be shifted to a time period except the request target time period. In a case where the request target time period is a negawatt request time period, the first ascertainment unit 72*b* ascertains whether or not predicted timings of cooling-time oil return operations can be shifted to a time period except the request target time period. In a case where the request target time period is a posiwatt request time period, the first ascertainment unit 72*b* ascertains whether or not predicted timings of at least one of a heating-time oil return operation and a defrosting operation can be shifted to a time period except the request target time period.

On the basis of the prediction results of the first prediction unit 72*a* and the ascertainment results of the first ascertainment unit 72*b*, the determination unit 72 determines special-operation timings.

On the basis of the prediction results of timings at which special operations are to be executed, in addition to an electric-power supply demand adjustment request from the outside, the operation control system 100 according to the present modification determines timings at which the special operations are to be executed, to suppress a decrease in the efficiency of demand response control.

In the present modification, as shown in FIG. 5, the management server 50 may further include an input unit 75 for inputting prediction information used for predicting the timings at which special operations are to be executed. The prediction information is input to the management server 50 by an administrator or the like of the operation control system 100. The prediction information is, for example, information related to the current season, consumed-electric-power aim values of the refrigerant cycle apparatuses 51*a*, . . . , information related to event occurrence situations in the properties 10, and an upper limit value and a lower limit value of a time interval between times during which a special operation is executed.

(2) Modification B

As shown in FIG. 5, in the present modification, the determination unit 72 further includes a second prediction unit 72*c* in Modification A.

The second prediction unit 72*c* predicts an increase and a diminishment in the electric power to be consumed by the refrigerant cycle apparatuses 51*a*, . . . due to the special operations. On the basis of, for example, operation data (the parameters (a) to (e) described above) used by the first prediction unit 72*a*, the second prediction unit 72*c* predicts a future trend of the consumed electric power in a case where the refrigerant cycle apparatuses 51*a*, . . . execute special operations.

On the basis of, in addition, the prediction results of the second prediction unit 72*c*, the determination unit 72 determines special-operation timings. In a case where the second prediction unit 72*c* predicts a diminishment in the consumed electric power, the determination unit 72 determines a special-operation timing such that the timing at which the special operation is to be executed is included in a negawatt request time period. In a case where the second prediction unit 72*c* predicts an increase in the consumed electric power, the determination unit 72 determines a special-operation timing such that the timing at which the special operation is to be executed is included in a posiwatt request time period.

On the basis of the prediction results of electric power to be consumed by special operations, in addition to an electric-power supply demand adjustment request from the outside, the operation control system 100 according to the present modification determines timings at which the special operations are to be executed, to suppress a decrease in the efficiency of demand response control.

(3) Modification C

In the present modification, electric-power supply demand adjustment request information includes a consumed-electric-power aim value at a predetermined time. The management server 50 further includes a second ascertainment unit 72*d*. Specifically, as shown in FIG. 5, the determination unit 72 further includes the second ascertainment unit 72*d*. The determination unit 72 determines special-operation timings on the basis of ascertainment results of the second ascertainment unit 72*d*.

The second ascertainment unit 72*d* compares the consumed-electric-power aim values of the refrigerant cycle apparatuses 51*a*, . . . and the predicted consumed-electric-power values of the refrigerant cycle apparatuses 51*a*, . . . to ascertain whether an electric-power supply demand adjustment request is a request with a trend toward suppressing the electric-power consumption or a request with a trend toward promoting the electric-power consumption. The consumed-electric-power aim values are input to the management server 50 by, for example, an administrator or the like of the operation control system 100. The predicted consumed-electric-power values are calculated by the management server 50 on the basis of operation data on the refrigerant cycle apparatuses 51*a*, . . . .

The operation control system 100 according to the present modification ascertains whether an electric-power supply demand adjustment request is a request with a trend toward suppressing the electric-power consumption or a request with a trend toward promoting the electric-power consumption. On the basis of the ascertained electric-power supply demand adjustment request, the operation control system 100 determines timings at which special operations are to be executed, to suppress a decrease in the efficiency of demand response control.

(4) Modification D

In the present modification, the storage unit 71 further stores peak information including at least one peak time at which a peak occurs in a trend related to the total electric power of the properties 10. On the basis of, in addition, the peak information, the determination unit 72 determines special-operation timings.

In the present modification, for example, the control unit 74 selects a total-electric-power demand value having the predetermined number of peaks, from all the total-electric-power demand values of the properties 10 in one day. The total-electric-power demand value is an average value of the electric power consumed by the properties 10 in a predetermined time period. For example, in a case where one day is divided into time periods of each 30 minutes, the total-electric-power demand value is an average value of the electric power consumed by the properties 10 in each time period. The number of peaks is the number of peak times included in the peak information. The control unit 74 includes a time period corresponding to the selected total-electric-power demand value, in the peak information as the peak times. The storage unit 71 stores the peak information created by the control unit 74.

On the basis of at least the peak information stored in the storage unit 71, the determination unit 72 determines special-operation timings. For example, the determination unit 72 determines timings at which cooling-time oil return operations are to be executed, in such a manner that the peak times included in the peak information are avoided. The determination unit 72 determines timings at which at least one of a heating-time oil return operation and a defrosting operation is to be executed, so that the at least one of the heating-time oil return operation and the defrosting operation is executed at the peak times included in the peak information.

On the basis of the peak information, the operation control system 100 according to the present modification determines timings at which special operations are to be executed, to suppress a decrease in the efficiency of demand response control.

(5) Modification E

In the present modification, the storage unit 71 includes electric-power market price information related to an electric-power market price. On the basis of the electric-power market price information, the determination unit 72 determines special-operation timings. The electric-power market price is, for example, an electric-power price (spot price) determined in an electric-power spot market that is an electric-power exchange market held by a wholesale electric-power exchange. In the electric-power spot market, for example, the exchange is performed in a unit of 30 minutes per period, and the electric-power price varies according to the electric-power demand, time periods, and the seasons. The electric-power market price information may be information related to a future usage-based unit price, such as a spot price, or may be information related to a usage-based unit price calculated on the basis of a spot price.

The determination unit 72 determines special-operation timings by regarding a time period in which an electric-power market price included in electric-power market price information is equal to or more than a first threshold, as at least one time period that is a target of an electric-power supply demand adjustment request with a trend toward suppressing the electric-power consumption. The determination unit 72 determines special-operation timings by regarding a time period in which an electric-power market price included in electric-power market price information is equal to or less than a second threshold, as at least one time period that is a target of an electric-power supply demand adjustment request with a trend toward promoting the electric-power consumption.

On the basis of the electric-power market price, the operation control system 100 according to the present modification determines timings at which special operations are to be executed, to suppress a decrease in the efficiency of demand response control, and reduce the electric-power rate.

The determination unit 72 may determine special-operation timings on the basis of both the electric-power supply demand adjustment request information and the electric-power market price information. The determination unit 72 may determine special-operation timings on the basis of at least one of the electric-power supply demand adjustment request information and the electric-power market price information, and the peak information.

(6) Modification F

In the embodiment, the operation control system 100 is a system that controls the operations of the refrigerant cycle apparatuses 51*a*, . . . installed in the at least one property 10. However, the operation control system 100 may be a system that controls the operations of the refrigerant cycle apparatuses 51*a*, . . . installed in at least one area. The area is a region where the refrigerant cycle apparatuses 51*a*, . . . that are control targets are installed. For example, the area is a predetermined region including at least one property 10.

(7) Modification G

Figure 6:
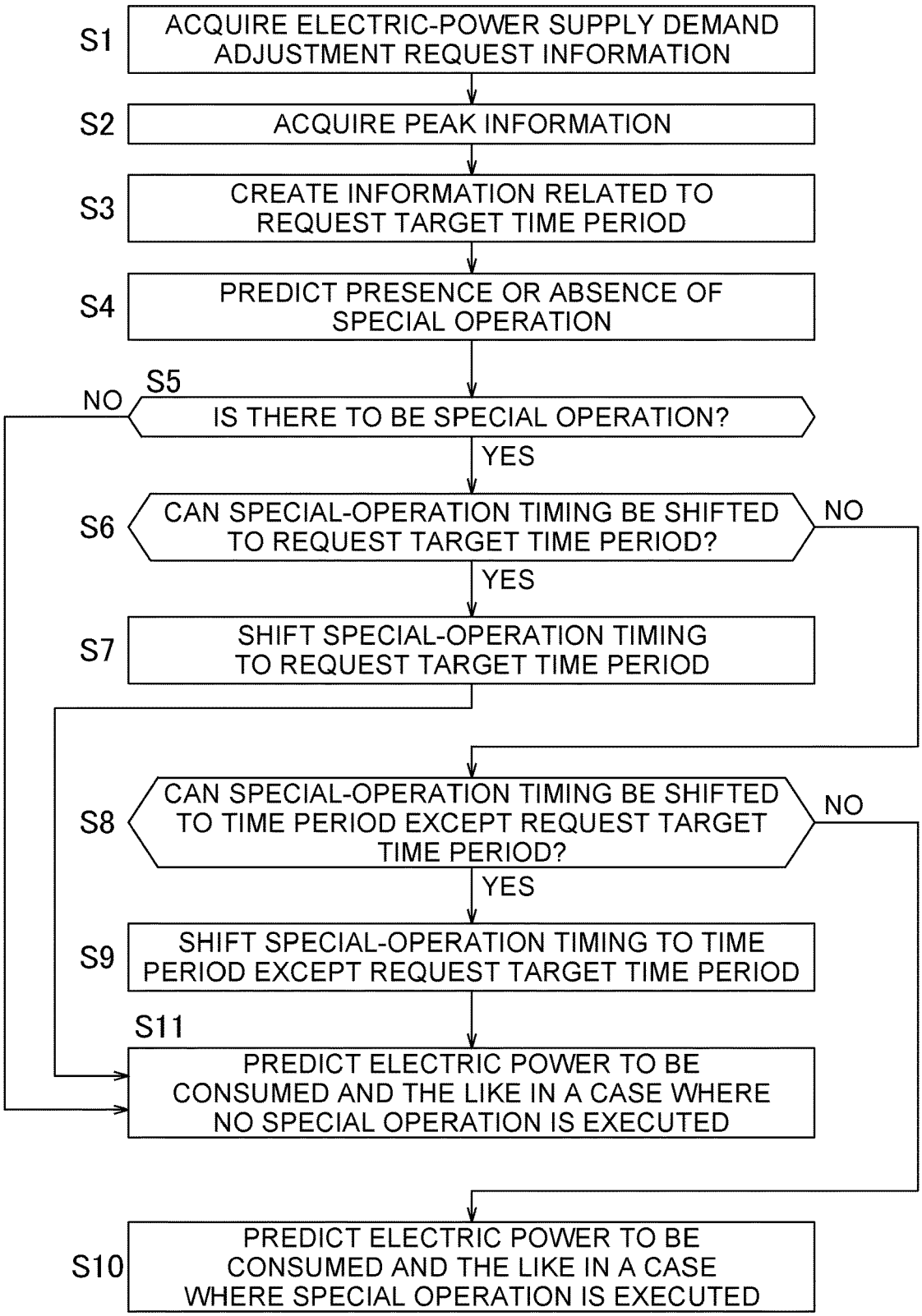
FIG. 6 is a flowchart for determining a special-operation timing in Modification G.

A specific example of a method in which the operation control system 100 determines special-operation timings will be described with reference to a flowchart of FIG. 6. In FIG. 6, the management server 50 determines special-operation timings of the refrigerant cycle apparatuses 51*a*, . . . on the basis of electric-power supply demand adjustment request information and peak information. However, the management server 50 may determine special-operation timings of the refrigerant cycle apparatuses 51*a*, . . . on the basis of only electric-power supply demand adjustment request information. In that case, step S2 in FIG. 6 is not executed.

In step S1, the management server 50 acquires electric-power supply demand adjustment request information from the outside. Specifically, the management server 50 acquires the electric-power supply demand adjustment request information on the basis of information stored in advance in the management server 50 and information input to the management server 50. The electric-power supply demand adjustment request information includes a time period in which there is an electric-power supply demand adjustment request from the outside. The management server 50 stores the acquired electric-power supply demand adjustment request information in the storage unit 71.

In step S2, the management server 50 acquires the peak information described in Modification D, if necessary. The peak information includes at least one peak time. The management server 50 stores the acquired peak information in the storage unit 71.

In step S3, the management server 50 creates information related to a request target time period in which special operations can be executed. On the basis of the electric-power supply demand adjustment request information acquired in step S1, the management server 50 creates the information related to the request target time period. In a case where the peak information is acquired in step S2, the management server 50 puts together the electric-power supply demand adjustment request information acquired in step S1 and the peak information acquired in step S2 to create the information related to the request target time period. The request target time period is a negawatt request time period or a posiwatt request time period.

In step S4, on the basis of operation data on the refrigerant cycle apparatuses 51*a*, . . . , the management server 50 predicts the presence or absence of a special operation that needs to be executed.

In step S5, the management server 50 ascertains whether or not there is to be the special operation predicted in step S4. In a case where there is to be the special operation predicted in step S4, in steps S6 to S10, the management server 50 determines a time period (special-operation timing) in which the special operation is to be executed. In a case where there is no special operation predicted in step S4, in step S11, the management server 50 executes demand response control in a case where no special operation is executed. In step S11, the electric power to be consumed by the refrigerant cycle apparatuses 51*a*, . . . , and the adjustment amounts of the electric power to be used by the refrigerant cycle apparatuses 51*a*, . . . in a case where no special operation is executed are predicted.

In step S6, according to the type of the special operation, the management server 50 ascertains whether or not the special-operation timing can be shifted to the request target time period (can be executed).

In a case where in step S6, the special-operation timing can be shifted, in step S7, the management server 50 shifts the special-operation timing to the request target time period and determines the special-operation timing. Then the process makes a transition to step S11.

In a case where in step S6, the special-operation timing cannot be shifted, in step S8, according to the type of the special operation, the management server 50 ascertains whether or not the special-operation timing can be shifted to a time period except the request target time period. The time period except the request target time period is, for example, a time period immediately before the request target time period.

In a case where in step S8, the special-operation timing can be shifted, in step S9, the management server 50 shifts the special-operation timing to a time period except the request target time period and determines the special-operation timing. Then the process makes a transition to step S11.

In a case where in step S8, the special operation timing cannot be shifted, in step S10, the management server 50 executes demand response control in a case where a special operation is executed. In step S10, the electric power to be consumed by the refrigerant cycle apparatuses 51*a*, . . . , and the adjustment amounts of the electric power to be used by the refrigerant cycle apparatuses 51*a*, . . . in a case where a special operation is executed are predicted.

CONCLUSION

Although the embodiments of the present disclosure have been described above, it will be understood that various changes in the forms and details can be made without departing from the spirit and scope of the present disclosure as set forth in the claims.

The invention claimed is:

1. An operation control system comprising:

a storage that stores electric-power information; and a processor configured to determine, based on the electric-power information, a special-operation timing at which a special operation of a refrigerant cycle apparatus installed in at least one property or at least one area is to be executed, the electric-power information including electric-power supply demand adjustment request information related to an electric-power supply demand adjustment request from an outside to the property or the area, the electric-power supply demand adjustment request information including at least one of a negawatt request time period that includes at least one time period that is a target of the electric-power supply demand adjustment request with a trend toward suppressing electric-power consumption, and a posiwatt request time period that includes at least one time period that is a target of the electric-power supply demand adjustment request with a trend toward promoting electric-power consumption, the special operation including a heating-time oil return operation during a heating operation of the refrigerant cycle apparatus, and the processor being configured to determine at least one of the special-operation timing at which the heating-time oil return operation is to be executed in the negawatt request time period, and the special-operation timing at which the heating-time oil return operation is to be avoided in the posiwatt request time period, the processor being configured to control the refrigerant cycle apparatus to execute the special operation at the special-operation timing.

2. The operation control system according to claim 1, wherein the processor is further configured to determine the special-operation timing at which the heating-time oil return operation is to be executed in a time period immediately before the posiwatt request time period.

3. The operation control system according to claim 2, wherein the processor is further configured to predict a predicted timing at which the special operation is to be executed based on operation data on the refrigerant cycle apparatus, ascertain whether or not the special operation can be executed in a request target time period that includes at least one time period that is a target of the electric-power supply demand adjustment request, and determine the special-operation timing based on the predicted timing and a result of the ascertaining whether or not the special operation can be executed in the request target time period.

4. The operation control system according to claim 2, wherein the special operation further includes at least one of a cooling-time oil return operation during a cooling operation of the refrigerant cycle apparatus, and a defrosting operation during a heating operation of the refrigerant cycle apparatus, and the processor is further configured to determine at least one of the special-operation timing at which the cooling-time oil return operation is to be executed in the posiwatt request time period, the special-operation timing the defrosting operation is to be avoided in the posiwatt request time period, and the special-operation timing at which the defrosting operation is to be executed in a time period immediately before the posiwatt request time period.

5. The operation control system according to claim 1, wherein the processor is further configured to predict a predicted timing at which the special operation is to be executed based on operation data on the refrigerant cycle apparatus, ascertain whether or not the special operation can be executed in a request target time period that includes at least one time period that is a target of the electric-power supply demand adjustment request, and determine the special-operation timing based on the predicted timing and a result of the ascertaining whether or not the special operation can be executed in the request target time period.

6. The operation control system according to claim 5, wherein the processor is configured to ascertain whether or not the predicted timing can be shifted to the request target time period.

7. The operation control system according to claim 6, wherein the processor is further configured to predict a change in electric power to be consumed by the refrigerant cycle apparatus due to the special operation, and determine the special-operation timing based on the change in electric power.

8. The operation control system according to claim 5, wherein the processor is further configured to predict a predicted change in electric power to be consumed by the refrigerant cycle apparatus due to the special operation, and determine the special-operation timing based on the predicted change in electric power.

9. The operation control system according to claim 8, wherein the processor is configured to in a case in which the predicted change in the electric power to be consumed is a decrease, determine the special-operation timing so that the special-operation timing is to be included in at least one time period that is a target of the electric-power supply demand adjustment request with a trend toward suppressing electric-power consumption, and in a case in which the predicted change in the electric power to be consumed is an increase, determine the special-operation timing so that the special-operation timing is to be included in at least one time period that is a target of the electric-power supply demand adjustment request with a trend toward promoting electric power consumption.

10. The operation control system according to claim 1, wherein the electric-power supply demand adjustment request information includes a consumed-electric-power aim value at a predetermined time, and the processor is further configured to compare the consumed-electric-power aim value with a predicted consumed-electric-power value based on operation data on the refrigerant cycle apparatus to ascertain whether the electric-power supply demand adjustment request is a request with a trend toward suppressing electric-power consumption or a request with a trend toward promoting electric-power consumption.

11. The operation control system according to claim 10, wherein the electric-power information further includes peak information including at least one peak time at which a peak occurs in a trend related to total electric power of the property or the area, and the processor is configured to determine the special-operation timing based on at least one of the electric-power supply demand adjustment request information and the electric-power market price information, and the peak information.

12. The operation control system according to claim 10, wherein the electric-power information includes the electric-power market price information, and the processor is configured to determine the special-operation timing by regarding a time period in which an electric-power market price included in the electric-power market price information is equal to or more than a first threshold, as at least one time period that is a target of the electric-power supply demand adjustment request with a trend toward suppressing electric-power consumption, and determine the special-operation timing by regarding a time period in which an electric-power market price included in the electric-power market price information is equal to or less than a second threshold, as at least one time period that is a target of the electric-power supply demand adjustment request with a trend toward promoting electric-power consumption.

13. The operation control system according to claim 1, wherein the electric-power information further includes peak information including at least one peak time at which a peak occurs in a trend related to total electric power of the property or the area, and the processor is configured to determine the special-operation timing based on at least one of the electric-power supply demand adjustment request information and the electric-power market price information, and the peak information.

14. The operation control system according to claim 13, wherein the electric-power information includes the electric-power market price information, and the processor is configured to determine the special-operation timing by regarding a time period in which an electric-power market price included in the electric-power market price information is equal to or more than a first threshold, as at least one time period that is a target of the electric-power supply demand adjustment request with a trend toward suppressing electric-power consumption, and determine the special-operation timing by regarding a time period in which an electric-power market price included in the electric-power market price information is equal to or less than a second threshold, as at least one time period that is a target of the electric-power supply demand adjustment request with a trend toward promoting electric-power consumption.

15. The operation control system according to claim 1, wherein the electric-power information includes the electric-power market price information, and the processor is configured to determine the special-operation timing by regarding a time period in which an electric-power market price included in the electric-power market price information is equal to or more than a first threshold, as at least one time period that is a target of the electric-power supply demand adjustment request with a trend toward suppressing electric-power consumption, and determine the special-operation timing by regarding a time period in which an electric-power market price included in the electric-power market price information is equal to or less than a second threshold, as at least one time period that is a target of the electric-power supply demand adjustment request with a trend toward promoting electric-power consumption.

16. The operation control system according to claim 1, wherein the special operation further includes at least one of a cooling-time oil return operation during a cooling operation of the refrigerant cycle apparatus, and a defrosting operation during a heating operation of the refrigerant cycle apparatus, and the processor is further configured to determine at least one of the special-operation timing at which the cooling-time oil return operation is to be avoided in the negawatt request time period, and the special-operation timing at which the defrosting operation is to be executed in the negawatt request time period.

17. An operation control method comprising using a storage and a processor to execute:

storing electric-power information; and determining, based on the electric-power information, a special-operation timing at which a special operation of a refrigerant cycle apparatus installed in at least one property or at least one area is to be executed; and controlling the refrigerant cycle apparatus to execute the special operation at the special-operation timing, the electric-power information including electric-power supply demand adjustment request information related to an electric-power supply demand adjustment request from an outside to the property or the area, the electric-power supply demand adjustment request information including at least one of a negawatt request time period that includes at least one time period that is a target of the electric-power supply demand adjustment request with a trend toward suppressing electric-power consumption, and a posiwatt request time period that includes at least one time period that is a target of the electric-power supply demand adjustment request with a trend toward promoting electric-power consumption, the special operation including a heating-time oil return operation during a heating operation of the refrigerant cycle apparatus, and the determining the special-operation timing including determining at least one of the special-operation timing at which the heating-time oil return operation is to be executed in the negawatt request time period, and the special-operation timing at which the heating-time oil return operation is to be avoided in the posiwatt request time period.

* * * * *